US006137504A

United States Patent [19]

Kawai et al.

[11] Patent Number: 6,137,504

[45] **Date of Patent: *Oct. 24, 2000**

[54] WIPING AND RECOVERY OF AN INK JET HEAD WITH INCLINED DISCHARGE PORT SURFACE

[75] Inventors: Tsutomu Kawai, Yokohama; Hisashi Morioka, Ushiku, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/795,723

[22] Filed: Feb. 4, 1997

Related U.S. Application Data

[63] Continuation of application No. 08/246,503, May 20, 1994, abandoned.

[30] Foreign Application Priority Data

| | | | |
|---|---|---|---|
| May 20, 1993 | [JP] | Japan | 5-118249 |
| May 21, 1993 | [JP] | Japan | 5-120075 |
| Jun. 7, 1993 | [JP] | Japan | 5-159933 |

[51] Int. Cl.[7] ..... B41J 2/165

[52] U.S. Cl. ..... 347/33; 347/29

[58] Field of Search ..... 347/22, 29, 47, 347/30–33, 44, 24; 49/477.1; 342/22, 29, 30, 32, 33; 15/256.5

[56] References Cited

U.S. PATENT DOCUMENTS

| | | | |
|---|---|---|---|
| 3,124,852 | 3/1964 | Holderer | 49/477.1 |
| 4,410,900 | 10/1983 | Terasawa | 347/30 |
| 4,819,012 | 4/1989 | Kiyohara et al. | 347/30 |
| 4,952,947 | 8/1990 | Kyoshima | 347/30 |
| 5,086,305 | 2/1992 | Terasawa | 347/30 |
| 5,117,244 | 5/1992 | Yu | 347/29 |
| 5,266,974 | 11/1993 | Koitabashi et al. | 347/33 |

FOREIGN PATENT DOCUMENTS

| | | | |
|---|---|---|---|
| 0446885 | 9/1991 | European Pat. Off. | 347/33 |
| 58-42467 | 3/1983 | Japan | 347/29 |
| 59-14965 | 1/1984 | Japan | 347/29 |
| 61-43570 | 3/1986 | Japan | 347/44 |
| 62-101448 | 5/1987 | Japan | 347/33 |
| 3-234623 | 10/1991 | Japan | 347/29 |

*Primary Examiner*—N. Le
*Assistant Examiner*—Thien Tran
*Attorney, Agent, or Firm*—Fitzpatrick, Cella, Harper & Scinto

[57] ABSTRACT

The present invention enables a more reliable and stable recovery operation on an ink jet head in which a shoulder is formed on a discharge port surface thereof. In the recovery operation, the discharge portion surface having an inclined surface portion constituting the shoulder is cleaned by a blade which is a rubber-like elastic member and which is movable on an axis on which discharge ports are arrayed on the discharge port surface. A distal end portion of the blade is parallel to the inclined surface portion and has a width which allows at least one edge of the blade to be within the inclined surface portion. Consequently, the blade can be pressed against the discharge port surface under a uniform contact pressure, and excellent cleaning can thus be achieved. In a structure in which a fence portion is provided on the discharge port surface having a shoulder or in which a balloon portion is provided in a cap portion, the contact between the cap and the discharge port surface is improved, and ink leakage which would occur during capping can be avoided.

14 Claims, 12 Drawing Sheets

WIPING AND RECOVERY OF AN INK JET HEAD WITH INCLINED DISCHARGE PORT SURFACE

This application is a continuation of application Ser. No. 08/246,503 filed May 20, 1994 now abandoned.

BACKGROUND OF THE INVENTION

1. Field of the Invention

The present invention relates to an ink jet recording apparatus for performing recording by discharging ink onto a recording material from recording means, and more particularly, to an ink jet recording apparatus which enables improved recovery.

2. Description of Related Art

A recording apparatus functioning as a printer, a copying machine, a facsimile machine or an output device for a composite machine containing a computer, a word processor or a work station, is designed to record images (including characters and symbols) on a recording material (a recording medium), such as paper or a thin plastic projector film, on the basis of image information. In recent years, ink jet recording apparatuses have been drawing attention and have come into wide use.

An ink jet recording apparatus performs recording by discharging ink onto a recording material from recording means (a recording head), and is advantageous in that the apparatus can be readily made compact, high-definition images can be recorded at a high speed, recording can be done on normal paper without special processing, running cost is low, the noise level is low because the apparatus uses non-impact recording, and color images can be readily recorded using inks of many colors.

Ink jet recording means (a recording head) for discharging ink by utilizing thermal energy is made up of electrothermal transducers and electrodes formed on a substrate (by semiconductor manufacturing processes, including etching, deposition and sputtering), liquid passage walls and a ceiling. Thus, an ink jet recording means in which the liquid passages (discharge ports) are disposed at a high density and which is thus more compact, can be readily manufactured. Further, an ink jet recording means can be readily made long or two-dimensional by utilizing integrated circuit technologies and micro-processing technologies, thus facilitating the provision of fully multiple or highly complex recording means.

When conducting recording with an ink jet recording apparatus, foreign matter, such as ink, dust or powder, may attach to the discharge port surface of a recording head (an ink jet head). In order to remove such foreign matter, wiping means is used, constructed to clean the discharge port surface by rubbing the surface with a blade made of a rubber-like elastic member, such as urethane rubber.

Conventionally, the surface of the recording head on which ink discharge ports are arrayed is flat. Thus, a cleaning blade having an edge shape corresponding to that flat surface has been used to clean the above recording head. Further, a cap member for protecting the discharge ports can be tightly fitted to the flat surface.

In recent years, recording heads in which a shoulder is formed on the discharge port surface thereof, shown in FIG. 1, have been proposed aimed for facilitating manufacturing and improving ink dischargeability.

FIG. 1 illustrates cleaning conducted on the recording head having such a discharge port surface using a conventional cleaning blade.

In FIG. 1, a blade 90 is moved along the axis on which discharge ports formed in a discharge port surface 91 are arrayed, i.e., perpendicular to the plane of the figure, so as to clean the discharge port surface 91. A first parallel surface portion 93 and a second parallel surface portion 94 are formed on a front surface of a recording head 92 (a head cartridge) on the right and left as viewed in FIG. 1, respectively, in such a manner that they form therebetween a shoulder having a predetermined height. The shoulder portion between the first and second parallel surface portions 93 and 94 is inclined to form an inclined surface portion which is the discharge port surface 91. The blade 90 is disposed such that the distal end thereof is parallel to the first and second parallel surface portions 93 and 94. The distal end portion of the blade 90 has a width W which is sufficiently larger than the width of the inclined surface portion 91, as shown in FIG. 1, and is disposed such that two edges thereof are within the first and second parallel surface portions 93 and 94, respectively.

In the ink jet recording apparatus, capping of the discharge port surface is performed during non-recording in order to prevent drying of ink near the discharge ports and to protect the discharge port surface. Conventionally, this capping is performed by pressing a cap, made of a rubber-like elastic member and provided on an apparatus body, against the discharge port surface, even if the discharge port surface is formed of the inclined surface portion 91.

However, in the ink jet recording apparatus with a head having such a discharge port surface, wiping such an inclined discharge port surface by the blade had the following disadvantages. First, since one edge of the distal end portion of the blade 90 extends to the first parallel surface portion 93 of the recording head 92, as shown in FIG. 1, the blade 90 cannot be brought into contact with the recording head uniformly, precluding the distal end of the blade 90 from making complete contact near the discharge ports of the inclined surface portion 91. Second, the contact pressure of the blade 90 against the inclined surface portion 91 (the discharge port surface) is irregular, generating stripes of wiped and non-wiped regions on the inclined surface portion 91. Third, excess ink is generated near the boundary between the discharge port surface 91 and the first parallel surface portion 93, scattering ink when the blade 90 is separated from the recording head 92. Fourth, the wiping conditions vary due to variations in the position of the recording head 92.

The conventional capping operation performed by pressing the rubber-like elastic cap, provided on the apparatus proper, against the discharge port surface formed by the inclined surface portion has the following disadvantages. First, since the discharge port surface is not a single flat surface but has a small inclined surface portion 91, when capping is performed at a predetermined position, ink leakage may occur due to positional deviation of the cap or due to deterioration in the accuracy with which the carriage with the recording head mounted thereon is moved. Second, since the cap provided on the apparatus proper is made of a rubber-like elastic member, the material may deteriorate with time through contact with the ink. Third, in order to eliminate the above-described ink leakage or deterioration in the material, an equalizing mechanism for bringing the cap into contact with and separating it from the discharge port surface must be provided. The equalizing mechanism has a complicated structure, is expensive and often malfunctions, making handling of the apparatus troublesome. Fourth, since there is no member for protecting the discharge port surface, the ink may flow out of the discharge port surface, or the discharge port surface may contact and be damaged by a bent or wrinkled sheet of recording paper.

SUMMARY OF THE INVENTION

In view of the above-described problems of the prior art, an object of the present invention is to provide an ink jet recording apparatus which enables a discharge port surface constituted by an inclined surface portion to be wiped under a uniform blade pressure, which can preclude ink from staying near the discharge ports, which enables the same wiping conditions to be maintained even if there are variations in the position of the recording head, and which enables a blade to be readily cleaned.

Another object of the present invention is to provide an ink jet recording apparatus which can preclude ink from leaking from a discharge port surface having an inclined surface portion while the discharge port surface is capped, which can overcome a problem involving deterioration in the elasticity of a sealing member made of, for example, a rubber-like elastic material, which enables omission of a cap equalizing operation and thus simplifies the structure of the apparatus and reduces failures and production cost, and which protects and prevents damage to the vicinity of the discharge ports of the discharge port surface.

Yet another object of the present invention is to provide a recovery device that can seal a discharge port surface of an ink jet head even if the discharge port surface is irregular, for example, because it is on an inclined surface. Thus, a sealed space can be reliably formed, so that suction applied to the discharge port in the surface will provide the desired discharge recovery.

In accordance with one aspect of the present invention, an ink jet recording apparatus for use with recording means for discharging ink onto a recording material, the recording means including a face with two surface portions having therebetween a discharge port surface inclined with respect to the surface portions, comprising an elastic blade having a distal end for wiping the face of the recording means, the distal end being parallel to the discharge port surface, and wiping means for moving the blade and the recording means relative to each other to wipe the face with the distal end of the blade, wherein the distal end of the blade does not overlap at least one of the surface portions while wiping the face.

In accordance with another aspect of the present invention, an ink jet recording apparatus comprises recording means for discharging ink onto a recording medium the recording means including a face with two surface portions having therebetween a discharge port surface inclined with respect to the surface portions and having discharge ports therein, and a protecting member on the face forming a barrier around the discharge ports for sealing the discharge ports from the atmosphere when the protecting member contacts a recovery device.

In accordance with yet another aspect of the present invention, an ink head recovery device for an ink jet recording apparatus comprises an ink suction pump having a mechanism for generating a pressure, and a cap having on an outer peripheral portion thereof a balloon portion that communicates with a positive pressure portion of the ink suction pump for inflating the balloon portion against an ink discharge surface of an ink head to form therewith a sealed space in communication with a negative pressure produced by said ink suction pump.

DETAILED DESCRIPTION OF THE PREFERRED EMBODIMENTS

Figure 2:
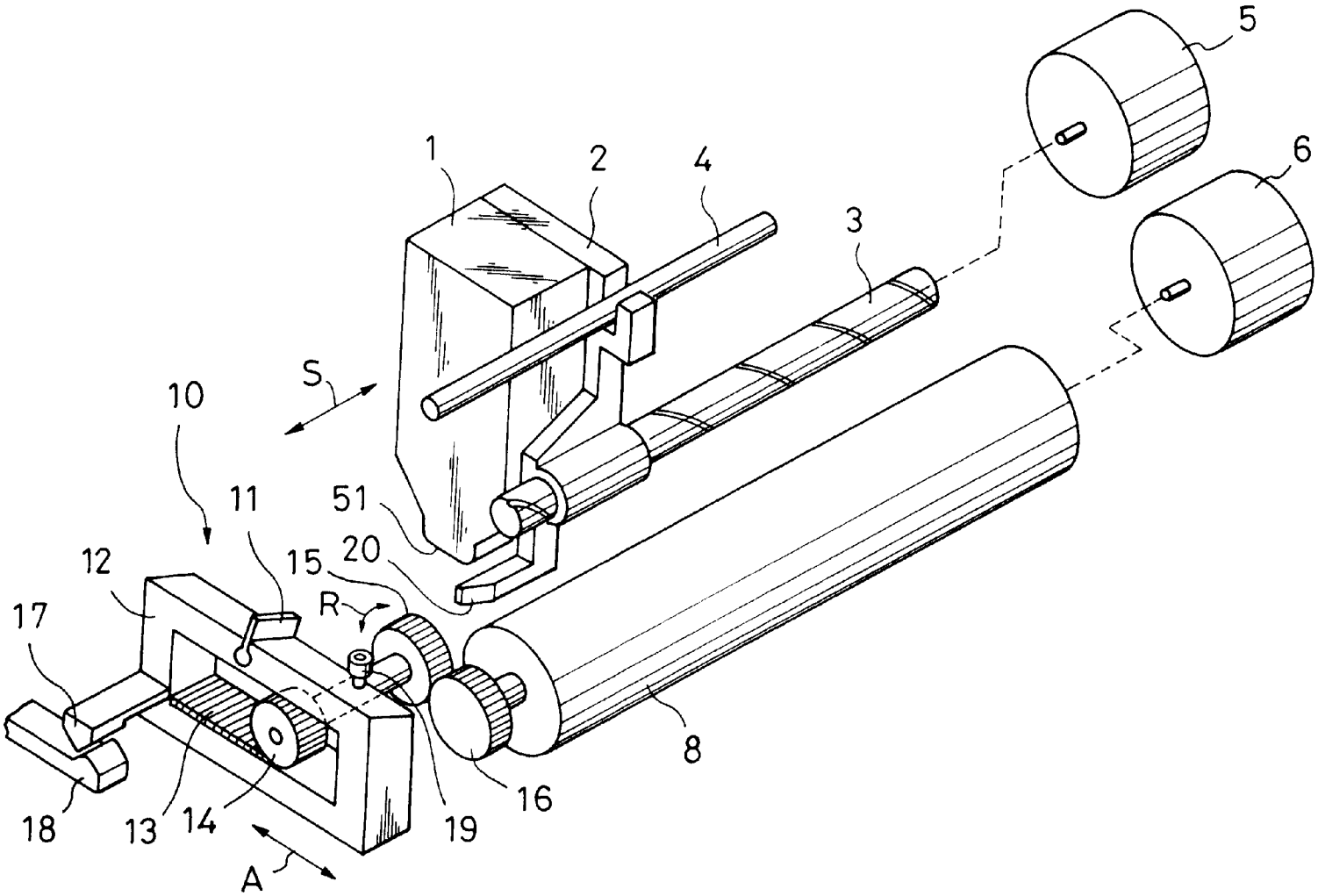
FIG. 2 is a schematic illustration of the essential parts of an ink jet apparatus to which the present invention is applied.

Embodiments of the present invention will be described below with reference to the accompanying drawings. FIG. 2 is a schematic perspective view showing a schematic configuration of an embodiment of an ink jet recording apparatus to which the present invention is applied. In FIG. 2, a recording means 1 (recording head) is mounted on a carriage 2. The carriage 2 is movably guided and supported by a lead screw 3 and a guide shaft 4 mounted on an apparatus proper. A carriage motor 5 for moving the carriage 2 is mounted on an end portion of the apparatus proper. The carriage 2 is reciprocatively movable in a main scanning direction by the action of the lead screw 3 rotated by the carriage motor 5.

Thus, the carriage 2 is reciprocatively scanned in the direction of arrow S by the normal and reverse rotations of the carriage motor 5, and the position of the carriage 2 is controlled by the amount of rotation of the carriage motor 5. Recording is performed by discharging an ink toward a recording material (such as a sheet of recording paper) from a discharge port of the recording means 1 during the travel of the carriage 2. In this embodiment, the recording means 1 (recording head) is a replaceable head cartridge in which an ink tank for supplying ink is formed integrally with the recording head.

The recording means 1 is an ink jet recording means for discharging ink utilizing thermal energy. The ink jet recording means includes electrothermal transducers for generating thermal energy. The recording means 1 performs recording by discharging the ink from the discharge port utilizing changes in the pressure generated by growth and contraction of a bubble due to film boiling caused by thermal energy applied by the electrothermal transducer.

Figure 3:
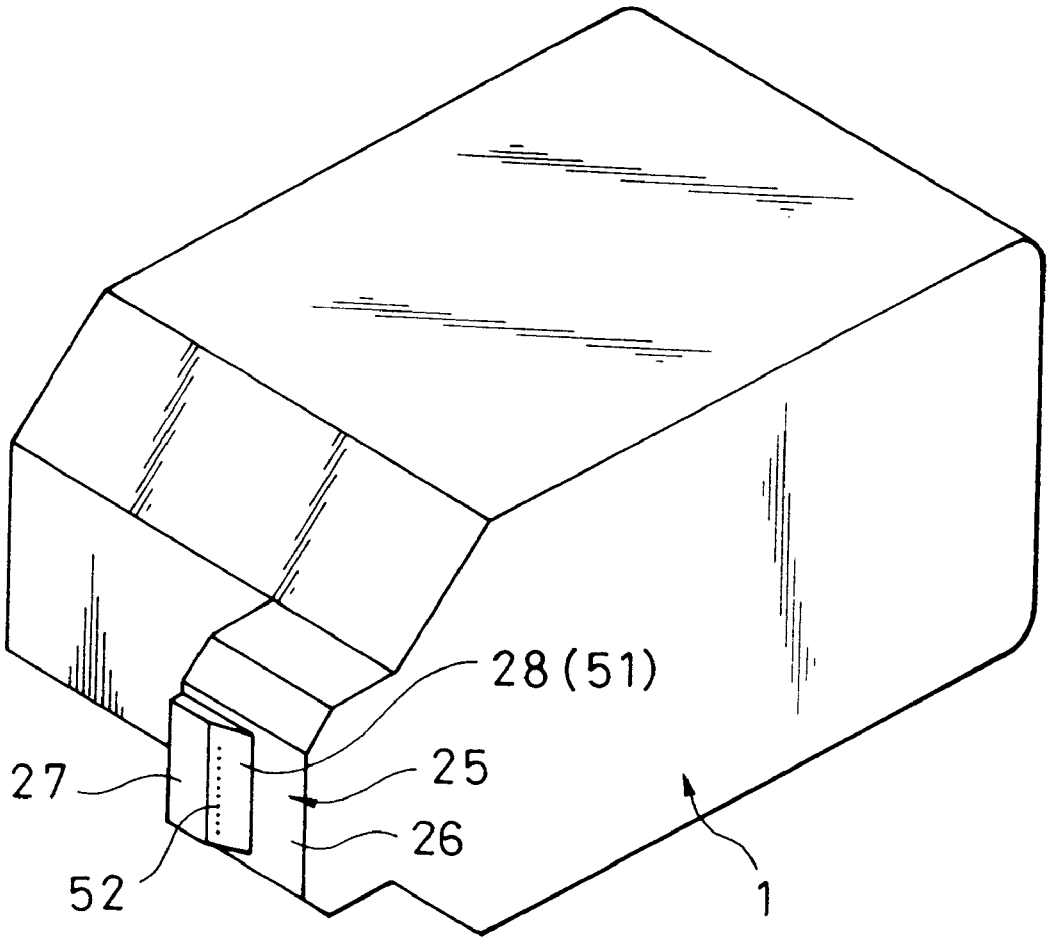
FIG. 3 is a schematic view of an example of an ink jet head cartridge.

FIG. 3 is a perspective view of the recording means 1 (head cartridge) as seen when looking from the side of the discharge port surface thereof. In FIG. 3, a first parallel surface portion 26 and a second parallel surface portion 27 are formed on a front surface 25 (the surface with which the recording head opposes the recording material) of the recording means 1 (head cartridge) on the right and left as viewed in FIG. 3, respectively, in such a manner that they form therebetween a shoulder having a predetermined height. The shoulder portion between the two parallel surface portions 26 and 27 is sloped to form an inclined surface portion 28 which is perpendicular to the axis on which discharge ports 52 are arrayed. The inclined surface portion 28 is a flat surface portion corresponding to a discharge port surface 51 shown in FIG. 2. In the inclined surface portion 28, the plurality of discharge ports 52 are arrayed in the longitudinal direction thereof.

In FIG. 2, a platen (not shown) is provided at a position which opposes the discharge port surface 51 of the recording head 1 parallel to the lead screw 3. The platen has a length which substantially covers the width of the recording material. The platen located at the recording position has the functions of retaining the recording material at a correct recording position, of preventing deformation of the recording material and of maintaining the gap between the recording material and the discharge port surface 51 at an adequate value. A convey roller 8 is disposed upstream of the recording position of the platen parallel to the lead screw 3. The convey roller 8 is rotated by a paper feed motor 6.

A pinch roller (not shown) is pressed against the convey roller 8 so as to convey the recording material which has been fed out from an automatic paper feed device (not shown) to the recording position (the position which opposes the discharge port surface 51). The pinch roller is pressed against the convey roller 8, whereby it is driven by the convey roller 8. The pressing force of the pinch roller is applied by, for example, a plate spring. A paper discharge roller (not shown) and a spur (not shown) are provided downstream of the recording position of the platen in order to discharge the recording material which has passed through the recording position. The frictional conveying force between the paper discharge roller and the spur is utilized to feed (convey) the recording material, as in the case of the convey roller 8 and the pinch roller.

The spur is pressed against the paper discharge roller, whereby it is driven by the paper discharge roller. The pressing force of the spur is applied by, for example, a plate spring through, for example, a spur holder (not shown). Where a jammed recording material is removed, the pinch roller and the spur can be separated (released) from the convey roller 8 and the paper discharge roller, respectively, by, for example, operating a lever. The paper discharge roller has the function of removing slack in the recording material which is conveyed in front of the recording head 1 and thereby preventing generation of errors of the recording position and contact of the recording material with the recording head 1. Hence, the paper discharge roller is generally rotated at a peripheral speed slightly higher than that of the convey roller 8 and driven synchronously with the convey roller 8.

Figure 1:
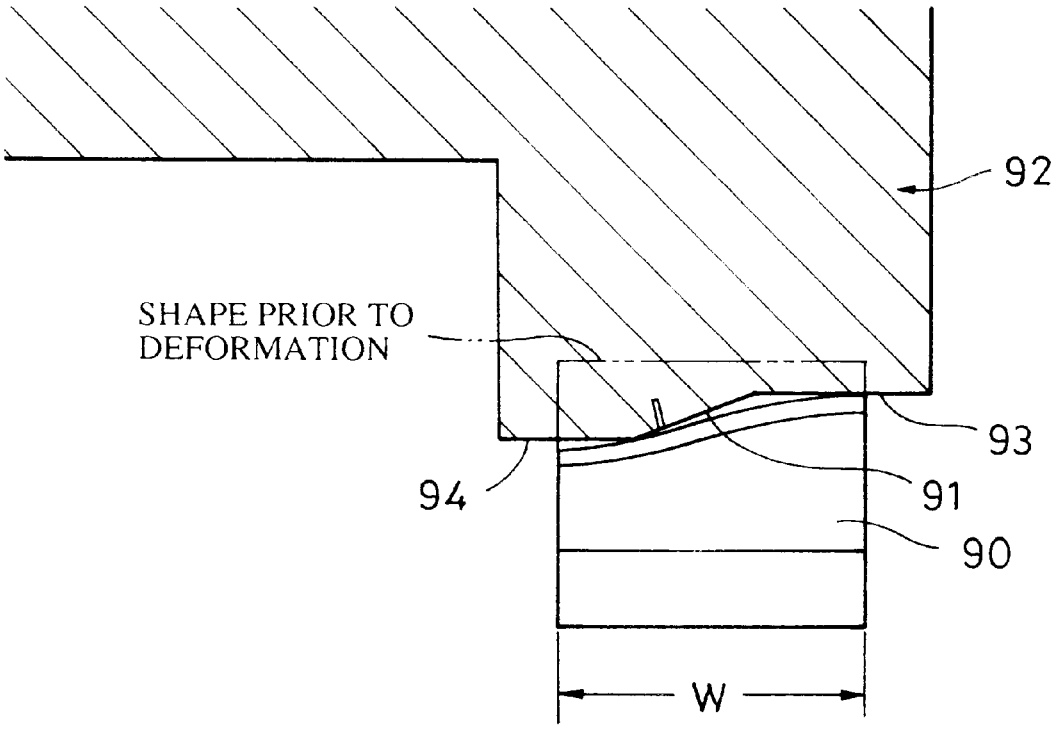
FIG. 1 PRIOR ART
FIG. 1 is a schematic illustration of a conventional recovery means.
Figure 4:
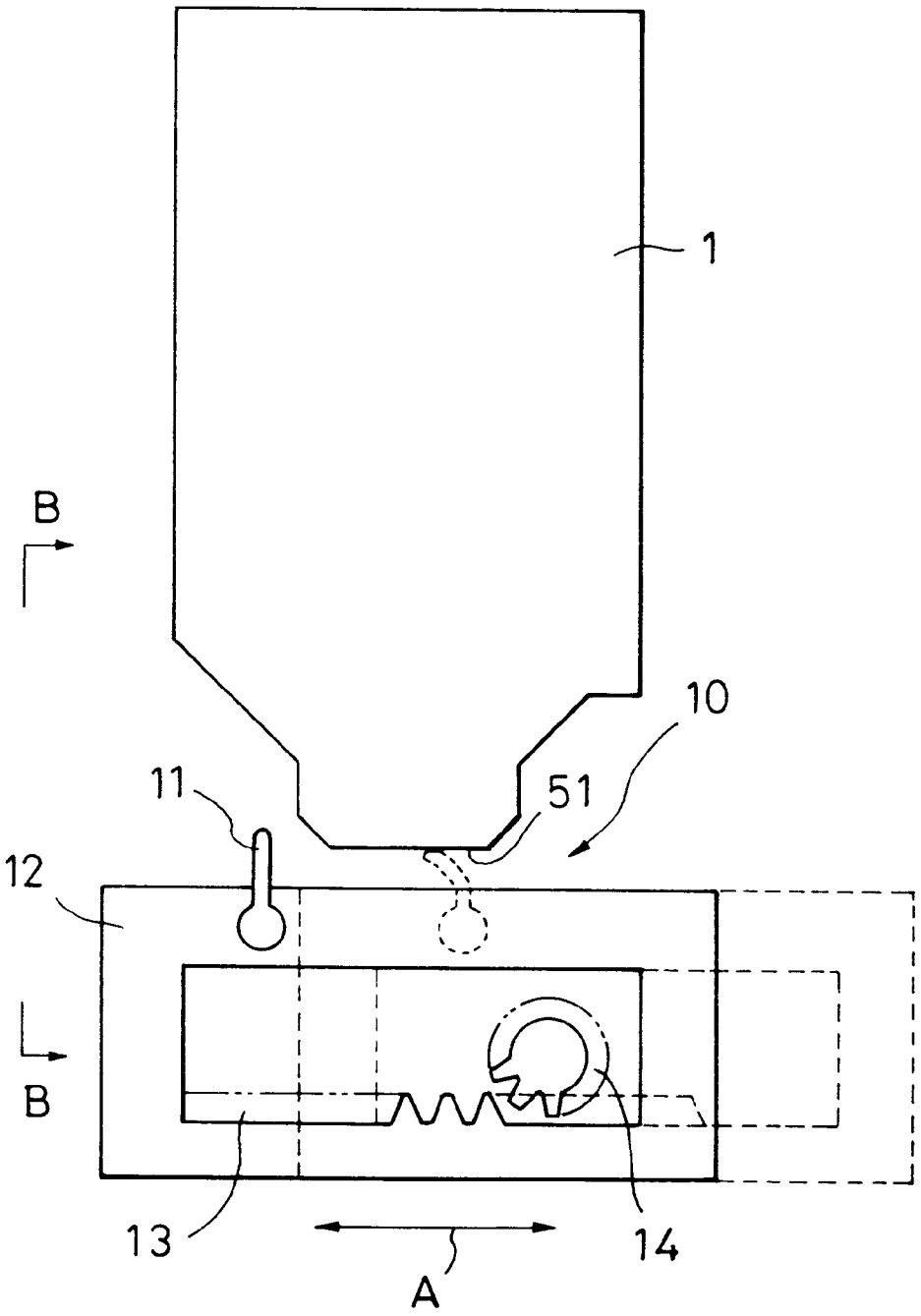
FIG. 4 is a schematic side elevational view showing a wiping operation of a cleaning mechanism for recording means shown in FIG. 2.

In FIG. 2, a recovery device containing a cleaning mechanism 10 is disposed outside of the recording area and within the range in which the carriage 2 is moved. The cleaning mechanism 10 is provided to remove foreign matter, such as ink or powder, attached to the discharge port surface 51 of the recording head 1. FIG. 4 is a schematic side elevational view illustrating the operation of the cleaning mechanism 10 shown in FIG. 1.

In the cleaning mechanism 10, a blade 11 for cleaning the discharge port surface 51 of the head cartridge 1 is mounted on a blade holder 12, as shown in FIGS. 2 and 4. The blade holder 12 is reciprocatively movable in the direction indicated by a bidirectional arrow A in which the discharge ports 52 are arrayed on the discharge port surface 51. In the structure shown in these figures, a rack 13 is formed on the blade holder 12. The rack 13 is engageable with a pinion 14 supported on the apparatus body for rotation in the direction of arrow R. A gear 15 formed integrally with and coaxially with respect to the pinion 14 is in meshing engagement with a gear 16 provided at one end of the convey roller 8. Consequently, the blade holder 12 and the blade 11 can be moved by rotating the convey roller 8 with the paper feed motor 6.

Further, a latch portion 17 is provided on the blade holder 12. The distal end portion of the latch portion 17 is in engagement with a stopper 18. A cam follower 19 is provided on the blade holder 12. The cam follower 19 is brought into contact with a carriage cam portion 20 provided on the carriage 2 when the carriage 2 comes to the cleaning mechanism 10.

The wiping operation performed by the cleaning mechanism 10 will now be described. In FIGS. 2 and 4, when the cartridge head 1 comes to a position where the discharge port surface 51 thereof is located at the cleaning position, the carriage cam portion 20 is brought into engagement with the cam follower 19, moving the cam follower 19 and the blade holder 12. When the blade holder 12 is moved, the pinion 14 is brought into mesh with the rack 13, and the latch portion 17 is released from the stopper 18. In a state wherein the pinion 14 meshes with the rack 13, the gear 15 is rotated through the convey roller 8 and the gear 16 with the paper feed motor 6, whereby the blade holder 12 is moved on a straight line indicated by the bidirectional arrow A and the discharge port surface 51 (the inclined surface portion 28) is thereby cleaned by the distal end portion of the blade 11 mounted on the blade holder 12.

When cleaning of the discharge port surface 51 is completed and the recording head 1 is moved to a position deviated from the cleaning position, the pinion 14 is rotated reversely, moving the blade holder 12 in a resetting direction. At that time, the blade 11 is returned to its original position without contacting the discharge port surface 51. The latch portion 17 rides on the stopper 18, and the pinion 14 is held (retained) at an untoothed portion of the rack 13, whereby the cleaning mechanism 10 is reset to its original state (waiting state).

Figure 5:
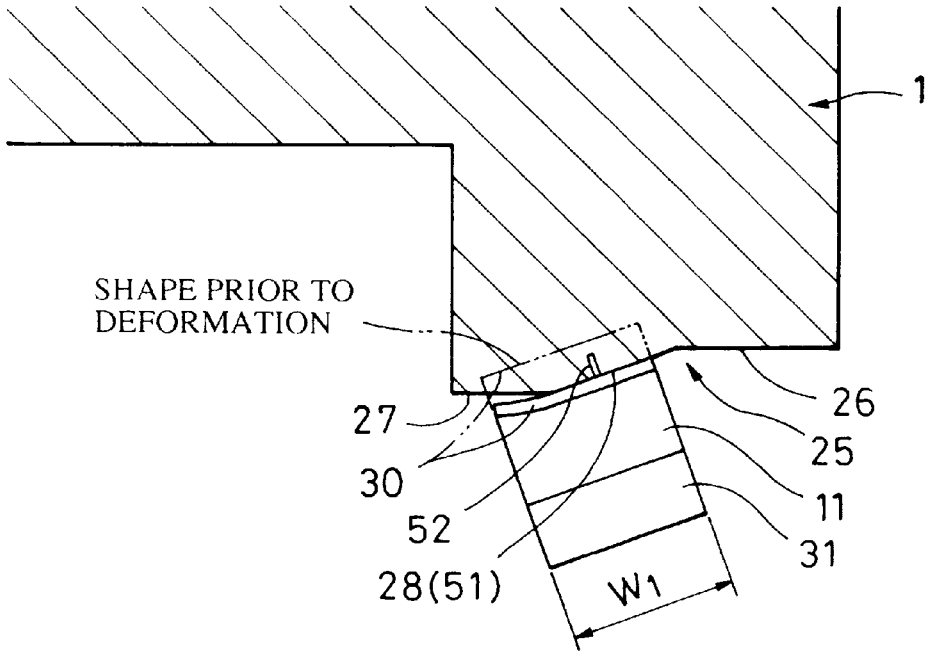
FIG. 5 is a schematic front view of an embodiment of the cleaning mechanism for an ink jet recording apparatus according to the present invention.

FIG. 5 is a schematic front view of the essential parts of the cleaning mechanism 10, showing an example of the structure thereof. In FIG. 5, the blade 11 is made of a plate-like elastic member. The blade 11 is mounted on the blade holder 12 in such a manner that a distal end portion 30 of the blade 11 is parallel to the inclined surface portion 28 and a supporting portion 31 (a base portion) is also parallel to the inclined surface portion 28. A width $W_1$ and layout of the blade 11 are set such that one of edges (a right edge as viewed in FIG. 5) of the distal end portion 30 of the blade 11 is within the inclined surface portion 28 and does not extend to the first parallel surface portion 26, which forms an inside angle (less than 180°) with the inclined surface portion 28. The other edge (a left edge as viewed in FIG. 5) of the distal end portion 30 of the blade 11 slightly projects from the inclined surface portion 28 over the second parallel surface portion, which forms an outside angle (greater than 180°) with the inclined surface portion 28. In this example, the blade 11 of the width $w_1$ is disposed with respect to the inclined surface 28, forming the discharge port surface 51, in the manner shown in FIG. 5, and the blade 11 is moved in the direction indicated by the bidirectional arrow A shown in FIG. 4 to clean the discharge port surface 51.

Figure 6:
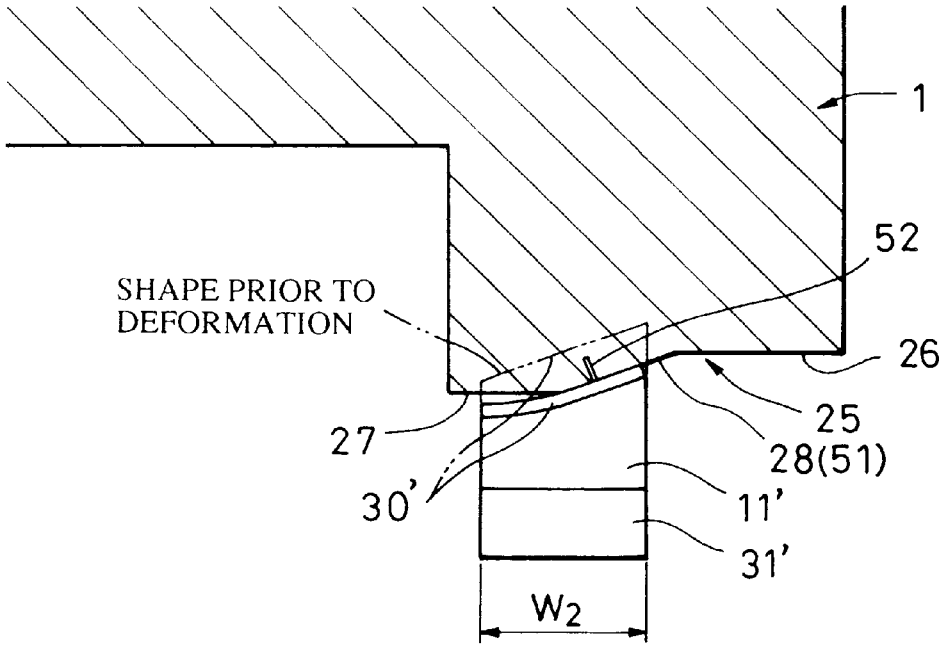
FIG. 6 is a schematic front view of another embodiment of the cleaning mechanism for an ink jet recording apparatus according to the present invention.

FIG. 6 is a schematic front view of the essential parts of the cleaning mechanism 10 showing another example of the structure thereof. In FIG. 6, the blade 11 is mounted on the blade holder 10 in such a manner that the distal end portion 30' thereof becomes parallel to the inclined surface 28 and that the supporting portion 31' (the base portion) becomes parallel to the parallel surface portions 26 and 27 and is inclined with respect to the discharge port surface 51 (the inclined surface portion 28). A width $W_2$ and layout of the blade 11' are set such that one of edges (a right edge as viewed in FIG. 6) of the distal end portion 30' of the blade 11' is within the inclined surface portion 28 and does not extend to the first parallel surface portion 26. The other edge (a left edge as viewed in FIG. 6) of the distal end portion 30' of the blade 11' slightly projects from the inclined surface portion 28. In this example, the blade 11' of the width $W_2$ is disposed with respect to the inclined surface 28, forming the discharge port surface 51, in the manner shown in FIG. 6, and the blade 11' is moved in the direction indicated by the bidirectional arrow A shown in FIG. 4 to clean the discharge port surface 51.

Figure 7:
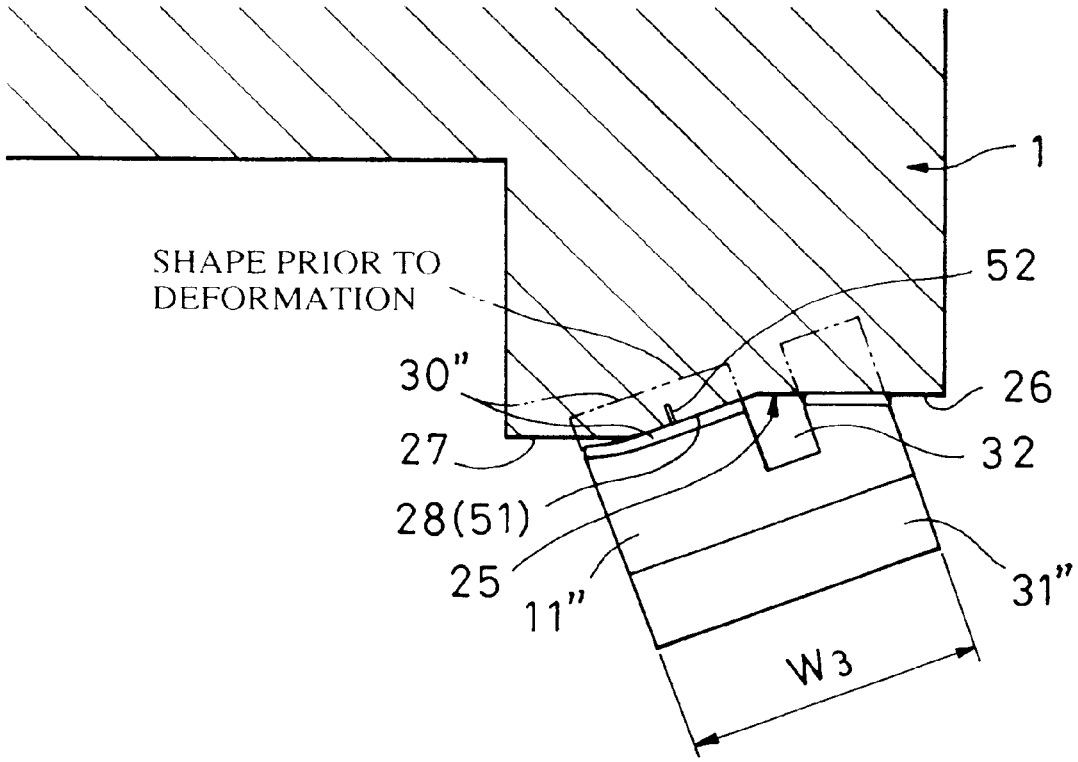
FIG. 7 is a schematic front view of still another embodiment of the cleaning mechanism for an ink jet recording apparatus according to the present invention.

FIG. 7 is a schematic front view of the essential parts of the cleaning mechanism 10 showing still another example of the structure thereof. In FIG. 7, the blade 11" is mounted on the blade holder 10 in such a manner that the distal end portion 30" thereof becomes parallel to the inclined surface 28 and that the supporting portion 31" (the base portion) also becomes parallel to the inclined surface portion 28. A width $W_3$ and layout of the blade 11" are set such that one of edges (a right edge as viewed in FIG. 7) of the distal end portion 30" thereof extends from the inclined surface portion 28 toward the first parallel surface portion 26. The distal end portion 30" of the blade 11 has a slit 32 (a notch) which extends over both the first parallel surface portion 26 and the inclined surface portion (discharge port surface) 28. The other edge (a left edge as viewed in FIG. 7) of the distal end portion 30" of the blade 11" slightly projects from the inclined surface portion 28.

In the example shown in FIG. 7, although the entire width $W_3$ of the blade 11" is large enough to allow the blade 11" to extend to the first parallel surface portion 26, since the slit 32 is formed at the intermediate portion of the blade 11" in such a manner that it extends over the inclined surface portion 28, the portion of the blade 11" associated with cleaning of the inclined surface portion 28 behaves in the same manner as that of the blade having the width of $W_1$ and allows the blade to make intimate contact with the surface portion 26. In this example, the blade 11" having the width $W_3$ is disposed with respect to the inclined surface 28, forming the discharge port surface 51, in the manner shown in FIG. 7, and the blade 11" is moved in the direction indicated by the bidirectional arrow A shown in FIG. 4 to clean the discharge port surface 51, as in the cases of the above examples.

The examples shown in FIGS. 2 through 7 are characterized in that the discharge port surface 51 of the recording head 1 is formed of the inclined surface portion 28 which is perpendicular to the axis on which the discharge ports 52 are arrayed, in that the cleaning mechanism 10, including the elastic blade which is movable on the axis on which the discharge ports 52 are arrayed, is provided to clean the inclined surface portion 28, and in that the width of the distal end portion of the blade and the layout thereof are set such that the distal end portion is parallel to the inclined surface portion 28 and that at least one of the edges of the blade is within the inclined surface portion 28. Consequently, the discharge port surface 51 formed of the inclined surface portion 28 can be wiped under a uniform pressure, and excess ink near the discharge port 52 can be eliminated. Further, even if there are small variations in the mounting position of the recording head 1, the same wiping conditions can be maintained, thus facilitating cleaning of the discharge port surface 51.

Figure 8:
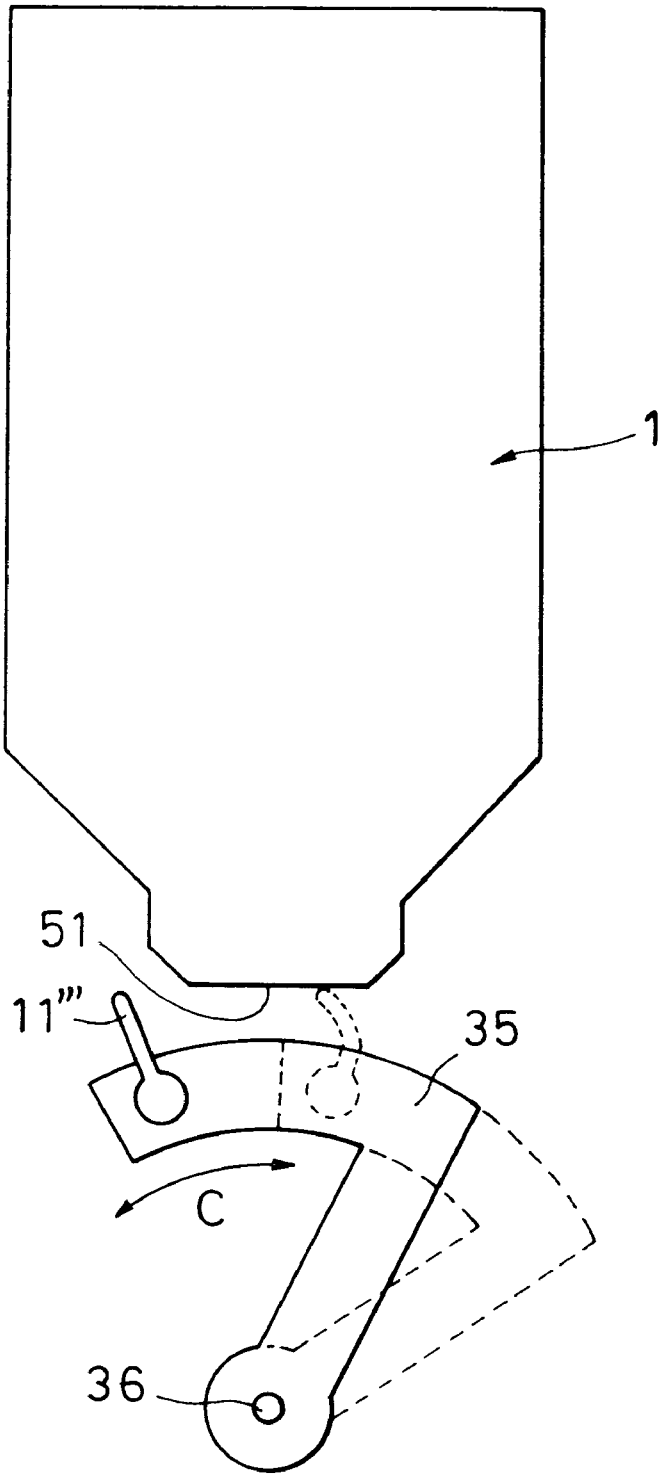
FIG. 8 is a schematic side elevational view showing another wiping operation of the cleaning mechanism for an ink jet recording apparatus according to the present invention.

In the examples shown in FIGS. 2 through 7, the blade performs a linear motion along a straight line parallel to the axis on which the discharge ports 52 are arrayed, as shown in FIG. 4. However, the blade may be rotated about a support so that the distal end portion thereof performs an elliptical motion along the axis on which the discharge ports 52 are arrayed. FIG. 8 is a schematic side elevational view illustrating how a rotating blade 11'" performs cleaning. In FIG. 8, an arm-like blade holder 35 is supported in such a manner as to be rotatable about a support 36, and the blade 11'" is mounted on the blade holder 35 at a predetermined position. The blade 11'" wipes the inclined surface portion 28 (the discharge port surface 51) when the blade holder 35 is rotated in a direction indicated by a bidirectional arrow C with a driving mechanism (not shown).

Figure 9:
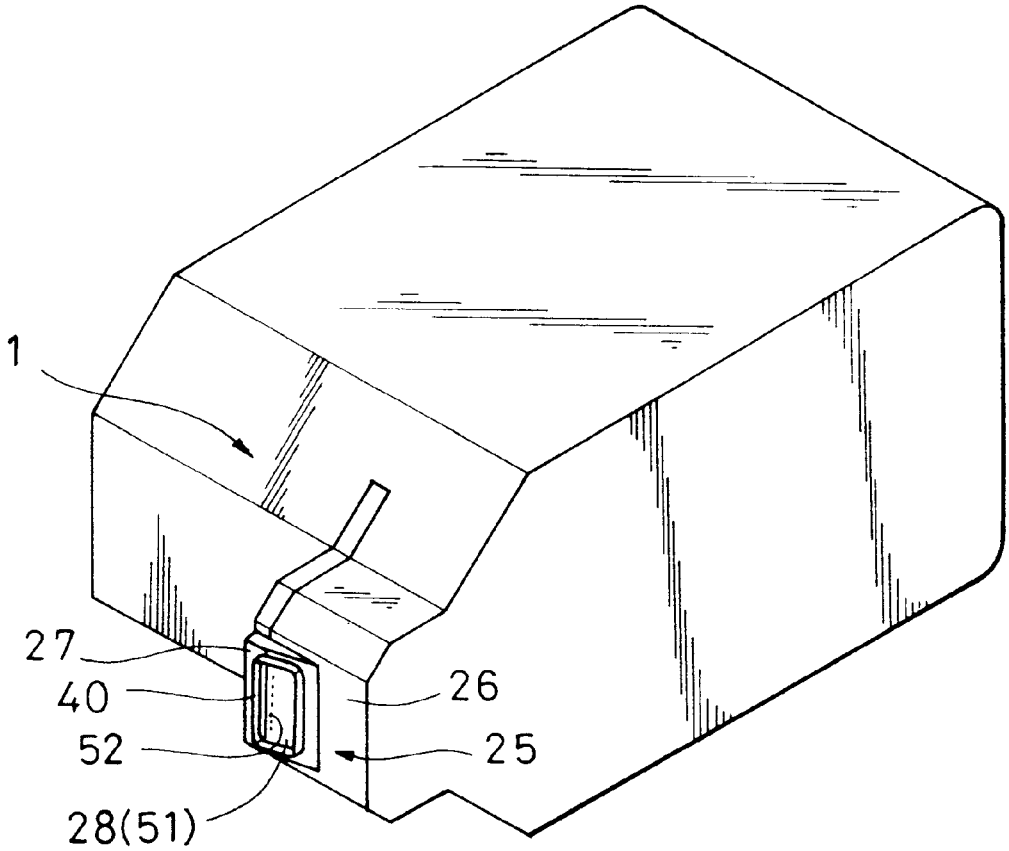
FIG. 9 is a schematic perspective view showing another embodiment of the recording means for an ink jet recording apparatus according to the present invention.
Figure 10:
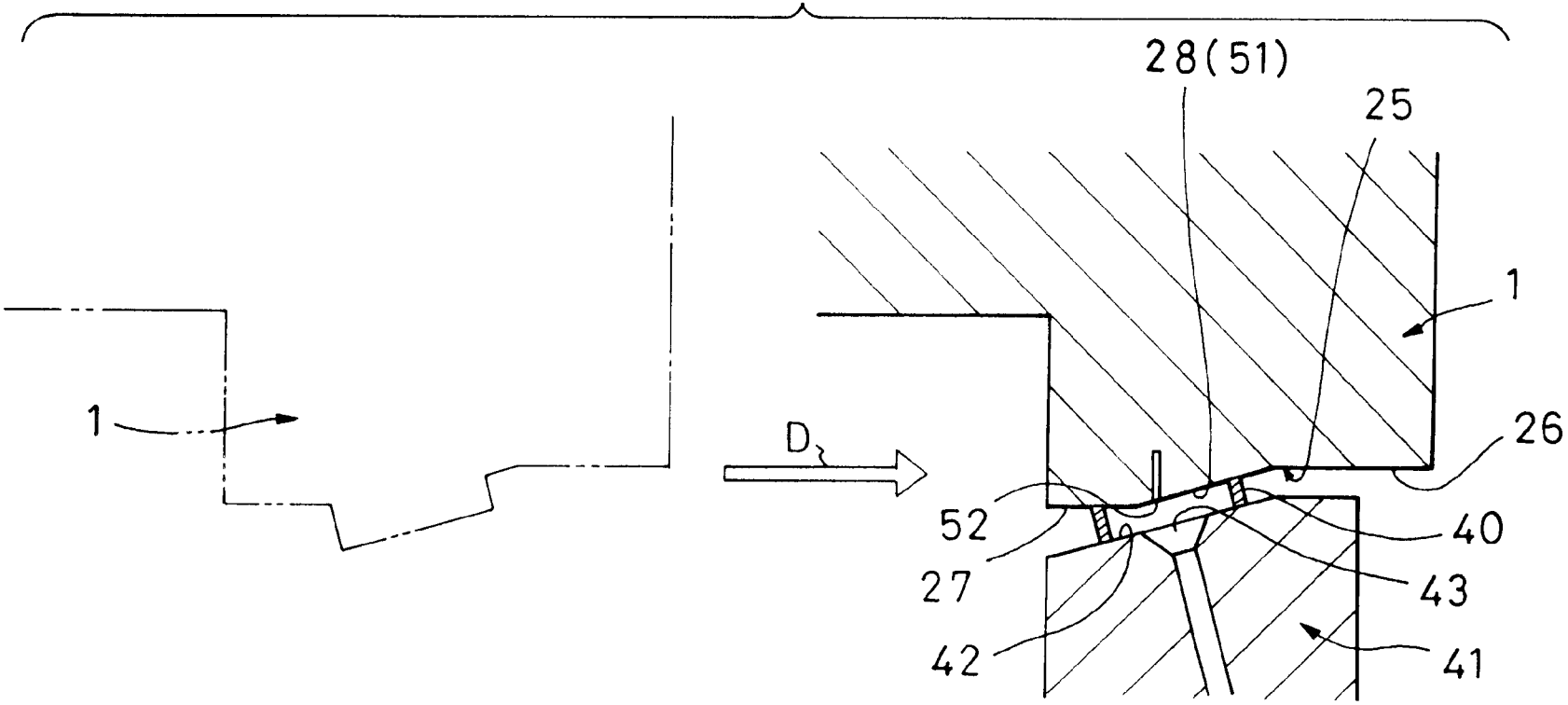
FIG. 10 is a front cross-sectional view schematically illustrating a capping operation for the recording means shown in FIG. 9.

FIG. 9 is a schematic perspective view showing another embodiment of the recording means of the ink jet recording apparatus to which the present invention is applied. FIG. 10 is a schematic cross-sectional view showing the state in which the recording means shown in FIG. 9 is moved to and capped by an ink suction portion of a recovery device. In FIGS. 9 and 10, the first parallel surface portion 26 and the second parallel surface portion 27 are formed on the front surface 25 of the head cartridge 1 (recording head) detachably (replaceably) mounted on the carriage 2 (FIG. 2) on the right and left as viewed in FIGS. 9 and 10, respectively, in such a manner that they form therebetween a shoulder having a predetermined height, as shown in FIG. 3. The shoulder portion formed between the two parallel surface portions 26 and 27 is sloped to form the inclined surface portion 28 which is perpendicular to the axis on which discharge ports 52 are arrayed. The inclined surface portion 28 is a flat surface portion corresponding to the discharge port surface 51 shown in FIG. 2. In the inclined surface portion 28, the plurality of discharge ports 52 are arrayed in the longitudinal direction thereof.

In this embodiment, a capping fence 40 having a predetermined height is provided in such a manner that it extends over both the inclined surface portion 28 (the discharge port surface 51) and the second parallel surface portion 27 and surrounds the discharge ports 52. The fence 40 is made of an elastic material, such as a synthetic rubber, and is fixed to the front surface 25 of the recording head 1 by, for example, an adhesive. The distal end surface of the fence 40 is on the same plane over the entire periphery of the fence 40, and has a shape which ensures that it can be closely attached to a similarly inclined opposing surface for sealing.

In FIG. 10, an ink suction portion 41 constituting the recovery device is disposed at a predetermined position which is outside of the recording area of the recording apparatus. The ink suction portion 41 has the function of sucking foreign matter, such as hardened ink, bubbles or dust, held in the discharge ports 52 by having a negative suction force act thereon. Consequently, ink discharge is maintained in a normal state, and discharge failure (including non-discharge of the ink) is eliminated. A slanting surface portion 42, which slants substantially parallel to the inclined surface portion 28, is formed on a front surface (which opposes the recording head 1) of the ink suction portion 41, and an ink suction port 43 communicating with a negative pressure source (which may be a suction pump) is opened at the central portion of the slanting surface portion 42.

When the carriage 2 (FIG. 2) is moved in a direction indicated by an arrow D and the recording head 1 thereby reaches the ink suction portion 41, the fence 40 is brought into close contact with the slanting surface portion 42, excluding the atmosphere from the discharge ports 52 in order to the discharge ports 52. The discharge ports 52 are uncapped by moving the recording head 1 in a direction opposite to the direction indicated by the arrow D. Thus, capping and uncapping of the discharge port surface 51 can be performed by moving the recording head 1 alone without moving the ink suction portion 41 provided on the apparatus proper (without performing an equalizing operation). Further, since the fence 40 made of an elastic member is formed integrally with the discharge port surface 51 in such a manner that it surrounds the discharge ports 52, contact of the precisely machined discharge ports 52 with other members, and hence damage to the discharge ports 52, can be prevented; that is, the fence 40 also functions as a discharge port protecting member.

The embodiment shown in FIGS. 9 and 10 is characterized in that the discharge port surface 51 of the recording head 1 is formed by the inclined surface portion 28 which is perpendicular to the axis on which the discharge ports 52 are arrayed, in that the fence-shaped discharge port protecting member 40 made of an rubber-like elastic material is provided on the discharge port surface 51 in such a manner that it surrounds the discharge ports 52, and in that the discharge ports 52 are capped by the discharge port protecting member 40 when the recording head 1 is located at a predetermined position, such as an ink suction position. Consequently, ink leakage, which would occur when the discharge port surface 51 is capped, can be eliminated, and deterioration in the elasticity of the sealing material 40, which may be made of a rubber-like elastic material, can be eliminated. Further, since the cap equalizing operation can be omitted, the apparatus is simplified, thus reducing the failures and production cost. Further, the protection function of preventing damage to the vicinity of the discharge ports of the discharge port surface 51 can be enhanced.

In the above embodiment, the fence-shaped discharge port protecting member 40 is made of a rubber-like elastic member. However, the discharge port protecting member 40 may also be made of a non-elastic member, such as a molded resin, while the slanting surface portion 42 of the ink suction portion 41 may be formed of a rubber-like elastic material, such as a synthetic rubber. Further, although the fence-shaped discharge port protecting member 40 is disposed in such a manner that it extends over both the inclined surface portion 28 and the second parallel surface portion 27 in the above embodiment, it may be formed such that it is within the inclined surface portion 28 in which the discharge ports 52 exist.

In the above-described embodiments, the serial recording apparatus in which the recording head 1 is mounted on the carriage 2 has been described. However, the present invention can also be applied to a line recording apparatus which performs recording only by feeding the recording paper using a recording head having a length which covers the entire width or part of the entire width of the recording material. Further, in the above embodiments, the case where recording is performed with the single recording head 1 has been described. However, application of the present invention is not limited by the number of recording heads or the recording colors, for example, the present invention can also be applied to a color recording apparatus which employs a plurality of recording heads to perform recording in different colors or a tone recording apparatus which employs a plurality of recording heads to perform recording using inks having the same color but different concentrations.

Further, in addition to an apparatus which employs a replaceable head cartridge in which the recording head and the ink tank are formed as one unit, the present invention can also be applied to apparatus in which the recording head and the ink tank are disposed in any layout, for example, an apparatus in which the recording head and ink tank, provided as separate units, are connected with each other via, for example, a tube.

Although the present invention can be applied to ink jet recording apparatus of the type which employs a recording means (a recording head) employing electromechanical transducer, such as a piezoelectric element, application of the present invention to an ink jet recording apparatus of the type which discharges ink utilizing thermal energy is the most effective because high-density and high-definition recording can be achieved in such a recording method.

Figure 11:
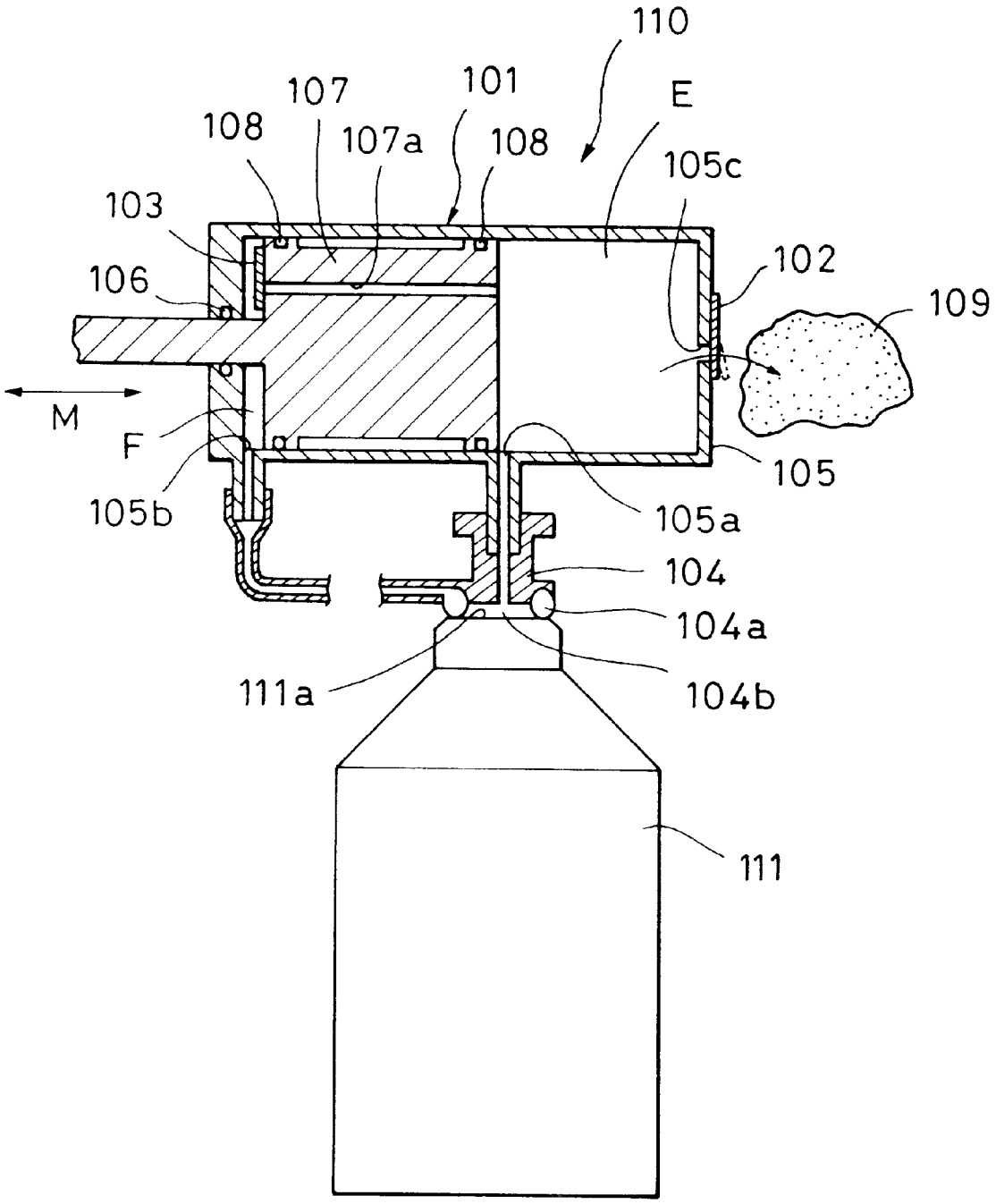
FIG. 11 is a schematic plan view illustrating suction of ink from an ink head in another embodiment of an ink head recovery device for an ink jet recording apparatus according to the present invention.
Figure 12:
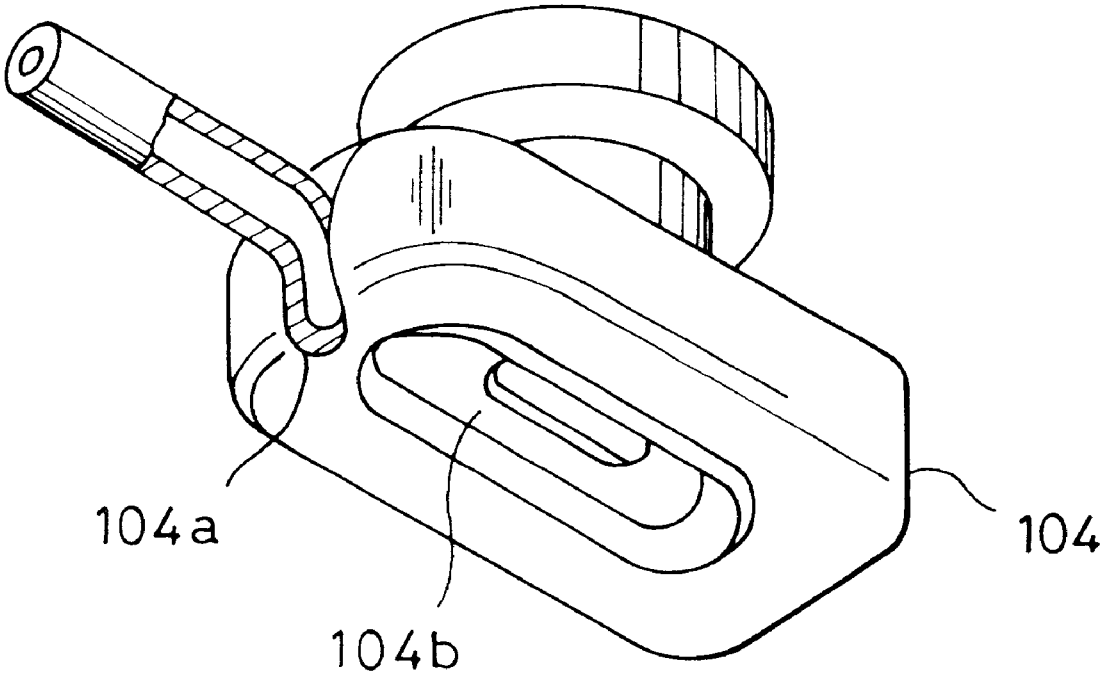
FIG. 12 is an enlarged perspective view of a cap shown in FIG. 11 as seen when looking from the left and below.

FIGS. 11 and 12 illustrate another example of the structure of closely attaching a cap against the head in which a shoulder is formed on the discharge port surface thereof.

As shown in FIGS. 11 and 12, an ink head recovery device 110 includes an ink suction pump 101 and a cap 104. The pump 101 includes a cylinder 105 and a piston 107. The cylinder 105 opposes an ink head 111 perpendicularly to a direction M of the motion of the piston 107. An orifice portion 105*a* is formed at an almost central portion of the side surface of the cylinder 105 which opposes the ink head 111, and a communication port 105*b* is formed at an left end portion thereof. The cap 104 is normally mounted on both the orifice portion 105*a* and the communication port 105*b* of the cylinder 105. The orifice portion 105*a* communicates with a cap chamber 104*b* of the cap to apply suction thereto, and the communication port 105*b* communicates with a balloon portion 104*a* to inflate it.

The cylinder 105 has a hole 105*c* through which an ink is discharged at the central portion of a right end thereof. A valve 102 is provided on the outer side of the hole 105*c*. The piston 107 has a hole 107*a* which passes therethrough on the axis on which it proceeds. A valve 103 is provided on the outer side of the left end of the piston 107. O-rings 106 and 108 are provided for hermetically sealing the piston and the cylinder. In the above-described mechanism, negative and positive pressures are respectively generated at the same time in pump chambers E and F of the cylinder 105 by moving the piston 107 in a leftward direction as viewed in FIG. 11. The generated negative and positive pressures are exerted on the cap chamber 104*b* and the balloon portion 104*a*, respectively.

The balloon portion 104*a* of the cap 104, which characterizes the present embodiment, is made of a substantially annular elastic member having a double structure, and is located at a position remote from a flange which engages with the orifice portion 105*a*. The balloon portion 104*a* is pressed against the distal end surface of the ink head 111 so as to hermetically seal the ink discharge surface 111*a*.

The operation of this embodiment will now be described.

The cap 104 is pressed against the ink discharge portion 111*a* of the ink head 111 so as to exclude the atmosphere from the ink discharge portion 111*a*. The cap 104 communicates with the ink suction pump 101 made up of the cylinder 105 and the piston 107. As the piston 107 moves leftward, the valve 102 closes the hole 105*c*, while the valve 103 closes the hole 107*a*, and the pump chamber E is evacuated. After the O-rings 108 have passed the orifice portion 105*a*, the cap chamber 104*b* is suddenly evacuated, sucking clogged ink into the chamber E. At that time, since the pump chamber F is compressed, the internal pressure of the balloon portion 104*a* increases and the balloon portion 104*a* thereby inflates. Accordingly, the contact portion of the balloon portion 104*a* is further pressed against and thereby uniformly attached to the ink discharge surface having a complicated figure. Consequently, the ink discharge portion is hermetically sealed, and the ink suction operation can thus be performed effectively. As the piston 107 moves rightward, the valves 102 and 103 open the holes, returning the internal pressure in the pump chambers E and F to the atmospheric pressure, and ink in the chamber E is introduced into a reservoir 109.

In the above embodiment, the ink head recovery device for the ink jet recording apparatus has been described. The present invention can also be applied to a recovery device for a cartridge storing box for storing a color ink head in a usable state.

Figure 13:
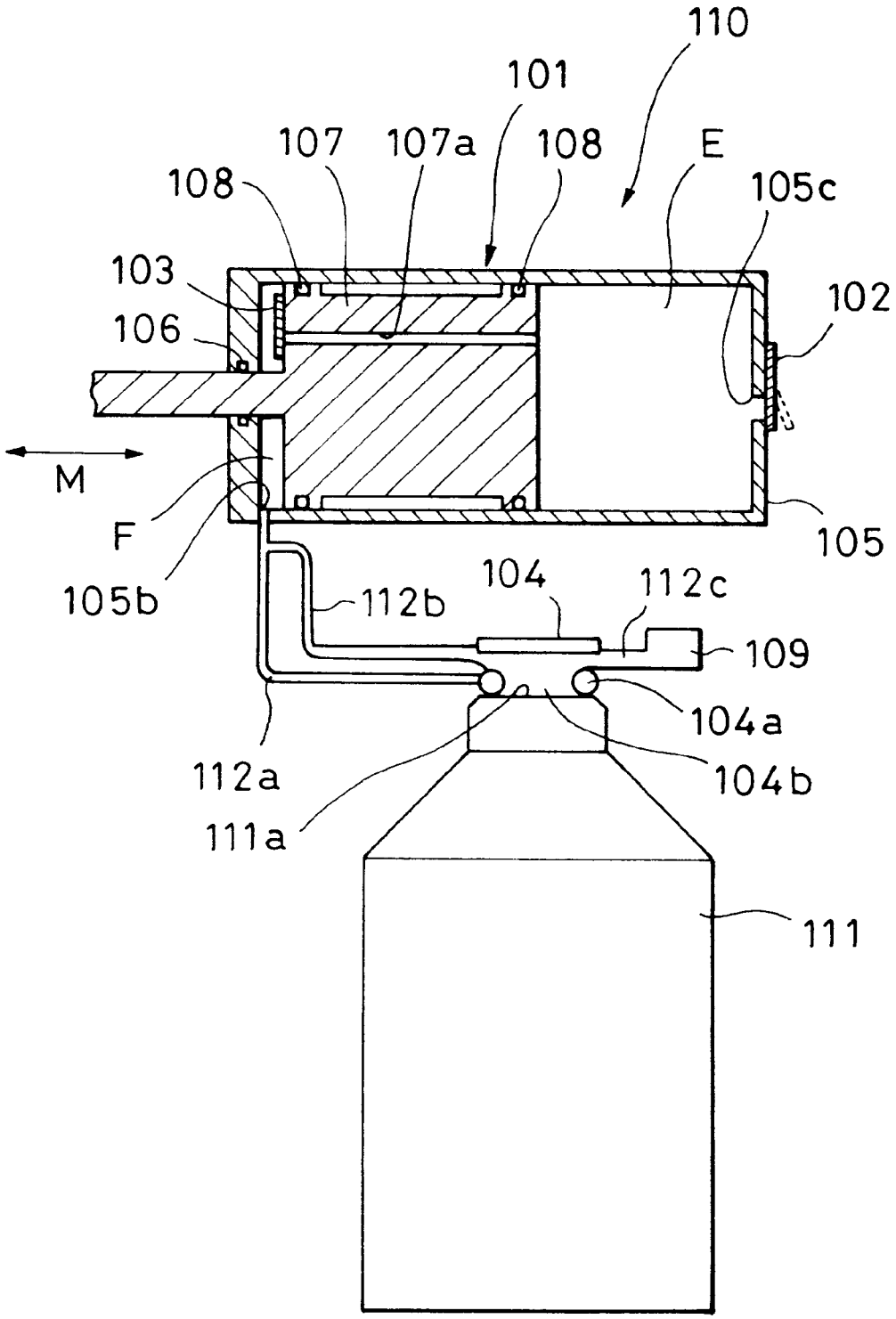
FIG. 13 is a schematic view of still another embodiment of the recovery device to which the present invention is applied.

FIG. 13 illustrates another example of the structure of the recovery system shown in FIG. 11. In this example, a path 112*b* branches from a path 112*a* for an air stream for inflating the balloon portion 104*a* and extends to the cap 104. The air stream for inflating the balloon portion 104*a* is passed through a discharged ink reservoir 109 at a high speed via the path 112*b*, the cap and a discharge pipe 112*c* by operating the pump.

When a stream of air flows through the cap 104 at a high speed, structure such as a venturi device decreases the internal pressure of the cap 104, sucking the ink from the ink discharge portion. The sucked ink flows into the discharged ink reservoir 109 together with the air stream.

As will be understood from the foregoing description, an air stream is caused to flow through the discharge passage in the cap for sealing the ink discharge portion of the ink head by using a positive pressure generation means, and the cap which communicates with that discharge passage is evacuated to suck the ink remaining in the ink discharge portion. Consequently, (1) Since there is no remaining pressure after ink suction, no ink remains in the cap, eliminating ink leakage due to an increased viscosity or hardening of the ink and reverse flow of the remaining ink toward the ink head.

(2) Since the wasted ink does not pass through the positive pressure generation means, the structure is simplified, and failures caused by an increased viscosity or hardening of the remaining ink can be eliminated.

As will be understood from the foregoing description, the ink jet recording apparatus according to the present invention performs recording by discharging ink from the recording means toward the recording material, and is characterized in that the discharge port surface of the recording head is formed by the inclined surface portion which is perpendicular to the axis on which the discharge ports are arrayed, in that the inclined surface portion can be cleaned by the blade which is made of a rubber-like elastic member and which moves in the axis on which the discharge ports are arrayed, and in that the shape and dimensions of the distal end portion of the blade are set such that the distal end portion is parallel to the inclined surface portion and that at least one edge of the distal end portion is within the inclined surface portion. Consequently, the discharge port surface formed of the inclined surface portion can be wiped under a uniform pressure, and the excess ink near the discharge ports can be eliminated. Further, even if there are small variations in the position of the recording head, the same cleaning conditions can be maintained, facilitating the cleaning operation.

In the ink jet recording apparatus according to the present invention performs recording by discharging ink from the recording means toward the recording material, and is characterized in that the discharge port surface of the recording means is formed of the inclined surface portion which is perpendicular to the axis on which the discharge ports are arrayed, in that the fence-shaped discharge port protecting member is provided on the discharge port surface in such a manner that it surrounds the discharge ports, and in that the discharge ports are screened from the atmosphere and capped by the discharge port protecting member when the recording means is located at a predetermined position, such as an ink suction position. Consequently, ink leakage, which would occur when the discharge port surface is capped, can be eliminated, and deterioration in the elasticity of the sealing material, such as the rubber-like elastic material, can be eliminated. Further, a cap equalizing operation can be omitted, and the apparatus can thus be simplified, thus reducing failures and production cost. Further, the protecting function for preventing damage to the discharge port surface near the discharge ports can be enhanced.

Further, in the ink head recovery device according to the present invention, since the cap contact portion with the ink discharge surface of the ink head has a balloon structure, even if the ink discharge surface is not a very flat surface, it can be pressed under a uniform pressure. Consequently, even if hardened ink or paper dust enters in the cap chamber, the cap chamber can be hermetically sealed during ink suction, and the suction pressure generation means can be provided without production cost increased.

What is claimed is:

1. An ink jet recording apparatus for use with recording means for discharging ink onto a recording medium, said recording means including a face with two surface portions having therebetween a discharge port surface inclined with respect to said surface portions such that a first border located between said discharge port surface and a first one of said surface portions is convex, and a second border located between said discharge port surface and a second one of said surface portions is concave, said apparatus comprising:

an elastic blade having a distal end with a continuous edge for wiping said face of said recording means, a portion of said edge of said distal end being parallel to said discharge port surface both before and during deformation of said blade due to wiping; and wiping means for moving said blade and said recording means relative to each other to wipe said face with said distal end of said blade, wherein said continuous edge of said distal end of said blade while wiping said discharge port surface overlaps said discharge port surface and the first one of said surface portions without overlapping the second one of said surface portions.

2. An ink jet recording apparatus according to claim 1, wherein said blade is movable along a straight line parallel to an axis along which discharge ports are arrayed on said discharge port surface.

3. An ink jet recording apparatus according to claim 1, wherein said blade is movable through a circular arc on an axis along which discharge ports are arranged on said discharge port surface.

4. An ink jet recording apparatus according to claim 1, wherein said recording means comprises ink jet recording means having an electrothermal transducer adapted to generate thermal energy utilized to discharge ink.

5. An ink jet recording apparatus according to claim 4, wherein said recording means discharges ink from said discharge ports by utilizing film boiling of ink by thermal energy generated by said electrothermal transducer.

6. An ink jet recording apparatus according to claim 1, wherein said blade includes a base end parallel to said discharge port surface.

7. An ink jet recording apparatus according to claim 1, wherein said surface portions are parallel and said blade includes a base end parallel to said surface portions.

8. An ink jet recording apparatus according to claim 1, wherein said discharge port surface forms an inside angle with a first said surface portions and an outside angle with a second said surface portion, and said blade overlaps said second said surface portion while wiping said face.

9. An ink jet recording apparatus according to claim 8, wherein said blade includes an auxiliary blade member for wiping said first said surface portion.

10. An ink jet recording apparatus according to claim 9, wherein said auxiliary blade member is integral with said blade and is separated from said distal end of said blade by a notch therein.

11. An ink jet recording apparatus comprising:

recording means for discharging ink onto a recording medium, said recording means including a face with two surface portions having therebetween a discharge port surface inclined with respect to said surface portions and having a discharge port therein; and a protecting member on said face forming a barrier around said discharge port for sealing said discharge port from the atmosphere when said protecting member contacts a recovery device, wherein said protecting member encloses said discharge port surface and a portion of one of said adjacent surfaces inclined thereto, and said protecting member has a variable height to which a distal end surface of said protecting member is parallel to said discharge port surface.

12. An ink jet recording apparatus according to claim 11, wherein said recovery device includes a suction device with a sealing face for contacting said protecting member when said recording means is in a predetermined position.

13. An ink head recovery device for an ink jet recording apparatus, said device comprising:

an ink suction pump having a mechanism for generating a pressure; and a cap having on an outer peripheral portion thereof a balloon portion that communicates with a positive pressure portion of said ink suction pump for inflating said balloon portion against an ink discharge surface of an ink head to form therewith a sealed space, wherein said positive pressure portion of said ink suction pump decreases a pressure inside said cap and causes waste ink to be sucked from an ink discharge port into a space inside said cap partly surrounded by said balloon portion and thereafter into a waste ink reservoir disposed away from said ink suction pump.

14. An ink head recovery device according to claim 13, wherein said ink suction pump includes a piston movable in a cylinder having a pressurizing port for introducing pressurized air to said balloon portion and said cap, said cap including structure for providing a reduced pressure in said sealed space in response to the introduction of pressurized air thereto.

* * * * *

UNITED STATES PATENT AND TRADEMARK OFFICE

CERTIFICATE OF CORRECTION

PATENT NO. : 6,137,504
DATED : October 24, 2000
INVENTOR(S) : Kawai et al.

It is certified that error appears in the above-identified patent and that said Letters Patent is hereby corrected as shown below:

Column 13,
Line 25, "portions" should read -- portion --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*